US005163300A

United States Patent [19]

Kato et al.

[11] Patent Number: 5,163,300

[45] Date of Patent: Nov. 17, 1992

[54] TEMPERATURE-RESPONSIVE CONTROLLER FOR REGULATING ICE PRODUCTION IN A REFRIGERATOR UNIT

[75] Inventors: Toshimitsu Kato, Ibaraki; Hiroshi Oike, Osaka, both of Japan

[73] Assignee: Kabushiki Kaisha Toshiba, Kanagawa, Japan

[21] Appl. No.: 760,457

[22] Filed: Sep. 17, 1991

[30] Foreign Application Priority Data

Sep. 18, 1990 [JP] Japan ..... 2-248130

[51] Int. Cl.[5] ..... F25C 5/04

[52] U.S. Cl. ..... 62/71; 62/135; 62/233

[58] Field of Search ..... 62/71, 72, 233, 353, 62/135

[56] References Cited

U.S. PATENT DOCUMENTS 3,423,949 1/1969 Leeson et al. ..... 62/233 X
4,424,683 1/1984 Manson ..... 62/233 X
4,475,357 10/1984 Linstromberg ..... 62/233 X
4,912,939 4/1990 Obermann et al. ..... 62/233
4,986,083 1/1991 Naruse et al. ..... 62/233 X

*Primary Examiner*—William E. Tapolcai
*Attorney, Agent, or Firm*—Cushman, Darby & Cushman

[57] ABSTRACT

An automatic ice maker in an ice making compartment of a refrigerator includes an ice tray placed in the ice making compartment, a temperature sensing element for sensing the temperture of the ice tray, an ice removing driver for driving the ice tray so that ice is removed from it, and a controller for controlling the ice removing driver. The controller initiates one or more timing operations when the temperature sensed by the temperature sensing element falls to or below one of a plurality of set temperatures. When one of these timing operations runs to completion, the system determines that the ice making operation has been completed. The time period corresponding to each set temperature decreases with decreasing set temperatures.

17 Claims, 5 Drawing Sheets

TEMPERATURE-RESPONSIVE CONTROLLER FOR REGULATING ICE PRODUCTION IN A REFRIGERATOR UNIT

BACKGROUND OF THE INVENTION

1. Field of the Invention

This invention relates to a refrigerator incorporating an automatic ice maker. The ice maker includes a temperature sensing element which senses the temperature of an ice tray so that completion of an ice making operation is detected based on the temperature sensed by the temperature sensing element.

2. Background Information

In a refrigerator of the type described above, an ice maker according to the prior art assumes an ice making step has been completed when the temperature sensed by a temperature sensing element falls to a set temperature or below. When the ice is made, a drive mechanism is operated to remove ice from the ice tray. The automatic ice maker as described above is usually provided in an ice making compartment of the refrigerator. In this type of ice maker, when refrigerating efficiency is high in compartments of the refrigerator, the temperature sensed by the temperature sensing element may have fallen to the set temperature even when not all of the water in the ice tray has been frozen. To solve this problem, the above-mentioned set temperature is usually set at a relatively low temperature such as −15° C. so that the complete freezing of the water in the ice tray is ensured even when the refrigerating efficiency is high, thereby preventing a faulty determination of the completion of the ice making step.

However, when the refrigerating efficiency is lower for some reason (for example, because of the increase in the quantity of water to be frozen), the temperature sensed by the temperature sensing element does not fall to the set temperature even when all of the water in the ice tray is completely frozen. Since the ice maker will not sense completion of the ice making step in such a case, the ice removing operation cannot be performed and accordingly, ice cannot be reserved in an ice reservoir.

SUMMARY OF THE INVENTION

Therefore, an object of the present invention is to provide a refrigerator incorporating an automatic ice maker wherein the completion of ice making in the ice tray can be determined with reliability.

The present invention relies upon the following concept: the water in the ice tray will freeze at 0° C. or below even if the refrigerating efficiency is low in the compartments of the refrigerator; accordingly, when the sensed temperature is at or below this set temperature for a certain length of time, but higher than a low set temperature as in the prior art, the completion of the ice making can be determined with reliability.

The present invention provides a refrigerator having an ice making compartment in which an ice maker is provided, the ice maker having an ice tray provided in the ice making compartment for containing an amount of water to be made into ice, a temperature sensing element for sensing the temperature of the ice tray, and ice removing drive means for driving the ice tray so that ice is removed from the ice tray. The invention also includes control means for controlling the ice removing drive means, the control means performing a timing operation when a temperature sensed by the temperature sensing element is at each one of a plurality of set temperatures or below, and the control means determining completion of the ice making operation based on the elapsing of a time period as measured by the timing operation, thereby operating the ice removing drive means. In this invention, the period of the timer operation corresponding to each set temperature decreases as the set temperature decreases.

When the refrigerating efficiency is low, the sensed temperature does not fall much. The system provides for this behavior by initiating a first timing operation when the sensed temperature falls to or below a high set temperature. The system determines that the ice making step is completed based when the first timing operation runs to completion. In this case the completion of the ice making can be determined with reliability when the duration of the first timing operation is set to a sufficiently long period to allow for the completion of the ice making.

When the refrigerating efficiency is high, the sensed temperature falls to or below a considerably low temperature by the time the ice making is completed. The system accounts for this behavior by initiating a second timing operation when the sensed temperature falls to or below the low set temperature. The system determines that the ice making operation is completed based when the second timing operation runs to completion. In this case the completion of the ice making operation can be determined with reliability and the time of detection of the ice making completion is shortened compared to the prior art arrangement.

In a preferred embodiment, the control means is provided with two set temperatures, a first timer timing a long duration for the high set temperature condition and a second timer timing a short duration for the low set temperature condition.

Also in a preferred embodiment, a storage compartment is provided over the ice making compartment and a water tank is provided in the storage compartment so that the water reserved in the water tank is supplied to the ice tray by a pump mechanism. In this embodiment, the period required for the ice making to be completed can be reduced since the water supplied to the ice tray is previously cooled in the storage compartment.

The control means of the ice maker may be provided with a plurality of set temperatures. In this case the completion of the ice making is detected immediately when the sensed temperature falls to or below the lowest set temperature. The timing operation is initiated when the sensed temperature falls to or below the other set temperature or each one of the other set temperatures other than the lowest set temperature. The completion of the ice making is detected upon the completion of one of these timing operations. In this case the completion of the ice making can be determined with reliability when the timed periods are set to a value sufficiently long to allow for completion of the ice making.

A method of making ice in a refrigerator comprises steps of supplying water to an ice tray provided in an ice making compartment, freezing the water in the ice tray by a chilled air supplied into the ice making compartment, initiating a timing operation when a sensed temperature of the ice tray falls to or below a one of a plurality of set temperatures, detecting completion of an ice making step based on the completion of one of these timing operations, and operating ice removing drive means so that ice is removed from the ice tray. In this invention, the period of the timer operation corresponding to each set temperature decreases as the set temperature decreases.

Other objects of the present invention will become obvious upon understanding of the illustrative embodiments about to be described or will be indicated in the appended claims. Various advantages not referred to herein will occur to one skilled in the art upon employment of the invention in practice.

BRIEF DESCRIPTION OF THE DRAWINGS

Embodiments of the present invention will be described with reference to the accompanying drawings in which.

DETAILED DESCRIPTION OF THE INVENTION

Figure 1:
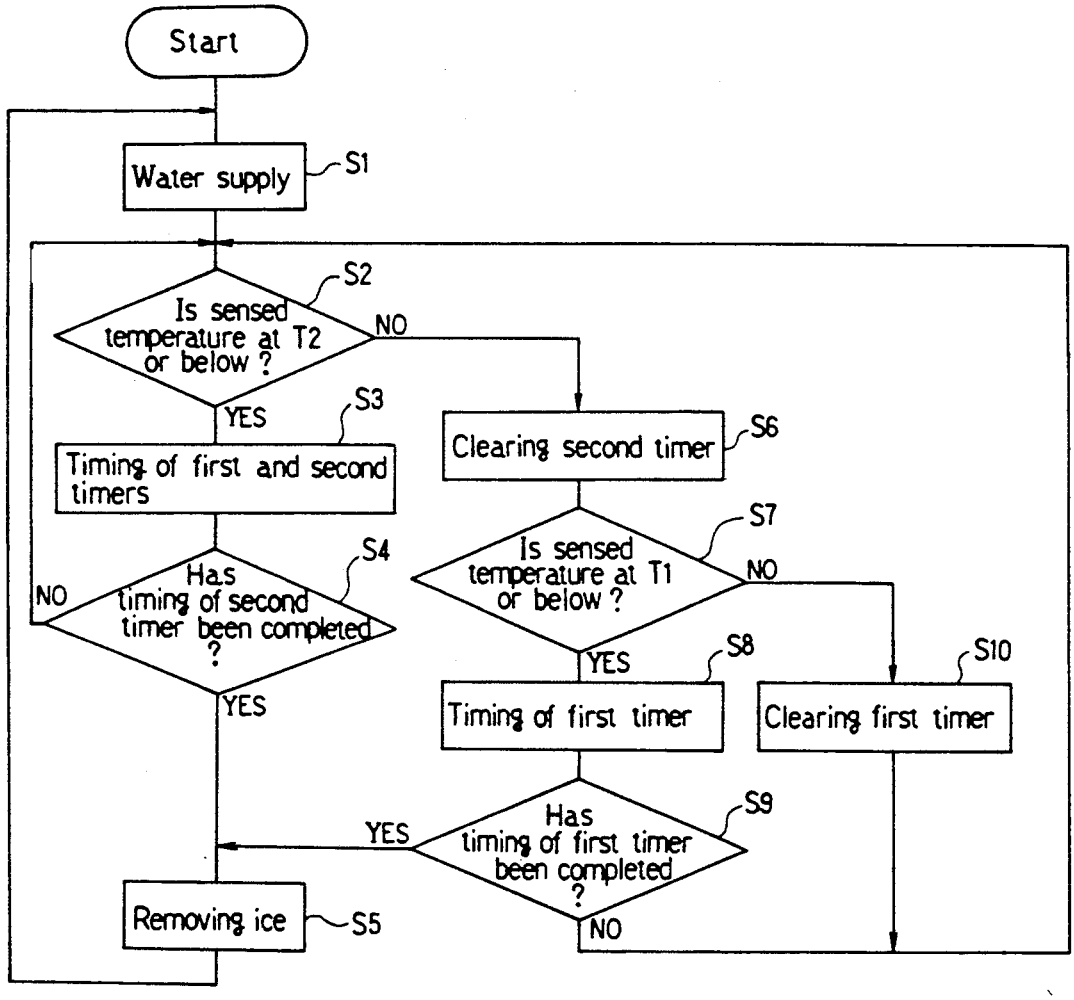
FIG. 1 is a flowchart for explaining the operation of the ice maker of a first embodiment incorporated in a refrigerator.
Figure 2:
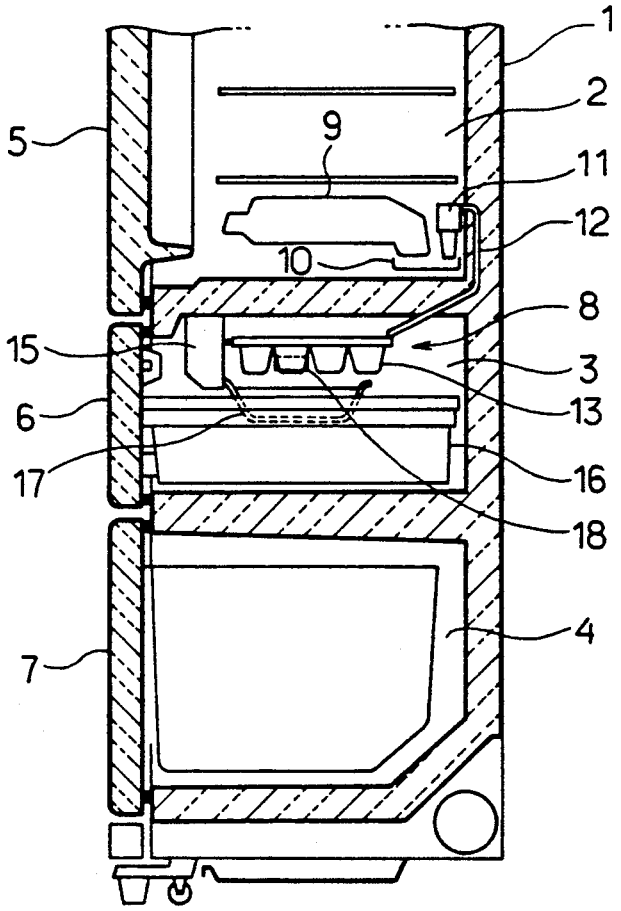
FIG. 2 is a longitudinal sectional view of the refrigerator.

A fist embodiment of the present invention will be described with reference to FIGS. 1 to 4 of the accompanying drawings. Referring first to FIG. 2, a refrigerator cabinet 1 has therein an uppermost storage compartment 2, an ice making compartment 3 below the storage compartment 2, a vegetable compartment 4 below the ice making compartment 3, and a freezing compartment (not shown). Doors 5 to 7, respectively, are provided for these compartments.

An automatic ice maker 8 is provided in the ice making compartment 3. A cartridge-type water tank 9 is disposed in the storage compartment 2. Water reserved in the water tank 9 is supplied to a water-receiving pan 10. The water received by the pan 10 is supplied to an ice tray 13 of the ice maker 8 through a water supply hose 12 by a pump 11 so that a predetermined amount of water is supplied to the ice tray 13.

In the automatic ice maker 8, the ice tray 13 is inverted and slightly twisted by a drive section 15 comprising a motor 14 (see FIG. 3) and reduction gear mechanism (not shown) after completion of an ice making step so that an ice removing operation is performed. The drive section 15 serves as ice removing drive means. An ice reserving box 16 is disposed below the ice tray 13 in the ice making compartment 3 for receiving ice removed from the ice tray 13. A detecting lever 17 is extended from the drive section 15 for detecting an amount of ice reserved in the ice reserving box 16. A temperature sensing element 18 is mounted on the outer bottom of the ice tray 13 for sensing the temperature of the ice tray 13.

Figure 3:
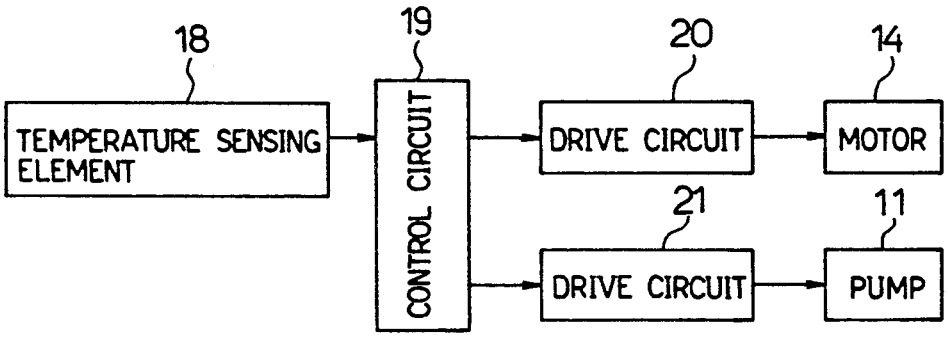
FIG. 3 is a schematic block diagram of the ice maker.

Referring to FIG. 3, a microcomputer-based control circuit 19 as control means has an internal memory for storing a program for controlling an overall operation of the refrigerator and also has a program for controlling the automatic ice maker 8. The temperature sensing element 18 senses the temperature of the ice tray 13 and generates a signal indicative of the temperature of the ice tray 13. The signal is supplied to the control circuit 19. The control circuit 19 controls drives the motor 14 of the drive section 15 and drives the pump 11 via drive circuits 20 and 21, respectively. The control circuit 19 in the embodiment includes a first built-in timer (not shown) for timing a period which is initiated when the sensed temperature falls to or below a first set temperature $T_1$ in FIG. 4. The control circuit 19 also includes a second built-in timer (not shown) for timing a period which is initiated when the sensed temperature falls to or below a second set temperature $T_2$.

In a preferred embodiment of the invention, the first set temperature $T_1$ is set at $-8°$ C. and the second set temperature $T_2$ at $-13.5°$ C., for example, so that the first set temperature $T_1$ is higher than the second set temperature $T_2$. A timing period of the first timer is set to several hours (e.g., three hours) and the timing period of the second timer is set to a few minutes (e.g., one minute).

Figure 4:
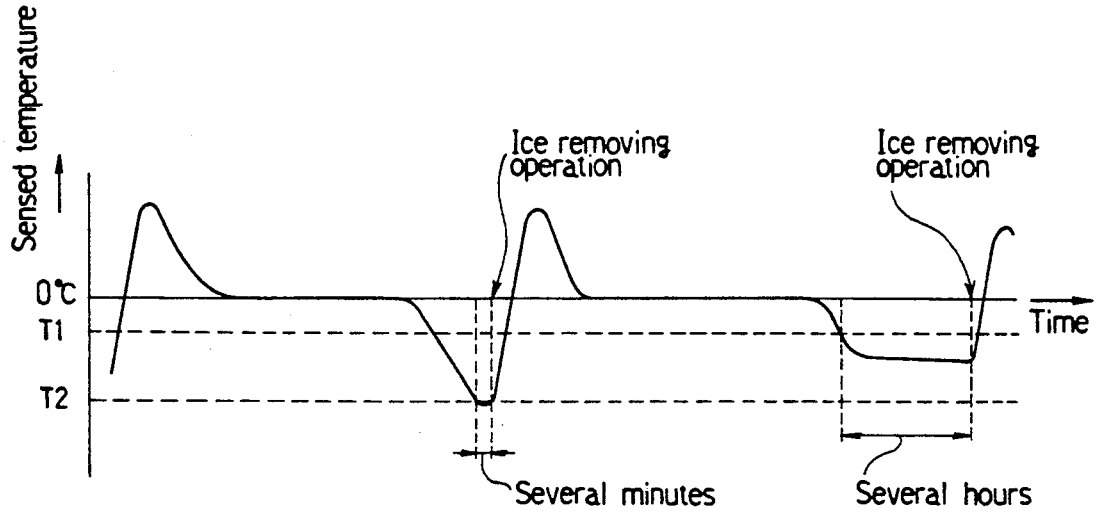
FIG. 4 is a graph showing the change in the temperature of the ice tray.

The operation of the invention will now be described. The case where the refrigerating efficiency is high will first be described. Referring to FIG. 1, the pump 11 is driven so that a predetermined amount of water is supplied to the ice tray 13 (step S1). The water in the ice tray 13 is cooled by chilled air fed into the ice making compartment 3, causing the ice making to progress in the ice tray 13. The sensed temperature from the temperature sensing 18 falls as the ice making progresses, as shown in FIG. 4. The timing operation of the first timer is initiated when the sensed temperature reaches or falls below the first set temperature $T_1$ (steps S2, S6–S8). Since the refrigerating efficiency is high, the sensed temperature falls further to the second set temperature before the completion of the timing operation of the first timer. When this occurs, the timing operation of the second timer is initiated (steps S2, S3). The completion of the ice making is determined when the timing operation of the second timer is completed several minutes later. When the ice making is completed, the ice tray 13 is reversed and twisted by the drive section 15 so that ice is removed from the ice tray 13 (steps S4, S5). Water is supplied to the ice tray 13 again after completion of the ice removing operation (step S1), and the above-described ice making is repeated. The ice making is repeated until a predetermined amount of ice is reserved in the ice reserving box 16.

In the case where the refrigerating efficiency is lower for some reason (for example, because of an increase in the quantity of water to be frozen), the sensed temperature does not fall to or below the second set temperature $T_2$ even when all of the water in the ice tray 13 has been frozen, as shown in the right-hand portion of the graph of FIG. 4. As before, the timing operation of the first timer is initiated when the sensed temperature falls to or below the first set temperature $T_1$ (steps S2, S6–S8). When the timing operation of the first timer is completed several hours later the initiation of the timing operation, the completion of the ice making is determined and the ice removing operation is performed (steps S9, S5). Subsequently, water is resupplied to the ice tray 13 so that the ice making is repeated.

In accordance with the above-described embodiment, the sensed temperature does not fall much when the refrigerating efficiency is low. In this case, the first timer initiates a first timing operation when the sensed temperature falls to or below the relatively high first set temperature $T_1$. The completion of the ice making is determined when this first timed period elapses. Accordingly, the completion of the ice making can be determined with reliability when the duration of the first timed period is set at to period sufficient for completing the ice making (e.g., several hours). This solves the prior art problem that the ice cannot be reserved in the ice reserving box 16. Furthermore, when the refrigerating efficiency is high, the sensed temperature falls to the relatively low second set temperature $T_2$ by the time the ice making is completed. In this case, the second timer initiates a second timing operation when the sensed temperature falls to or below the second set temperature. The completion of the ice making is determined when this second timed period elapses. Accordingly, the ice making can be detected with reliability when this second timed period is set at a short period (e.g., a few minutes). Consequently, the time when the completion of the ice making is determined is shortened compared to the prior art.

Figure 5:
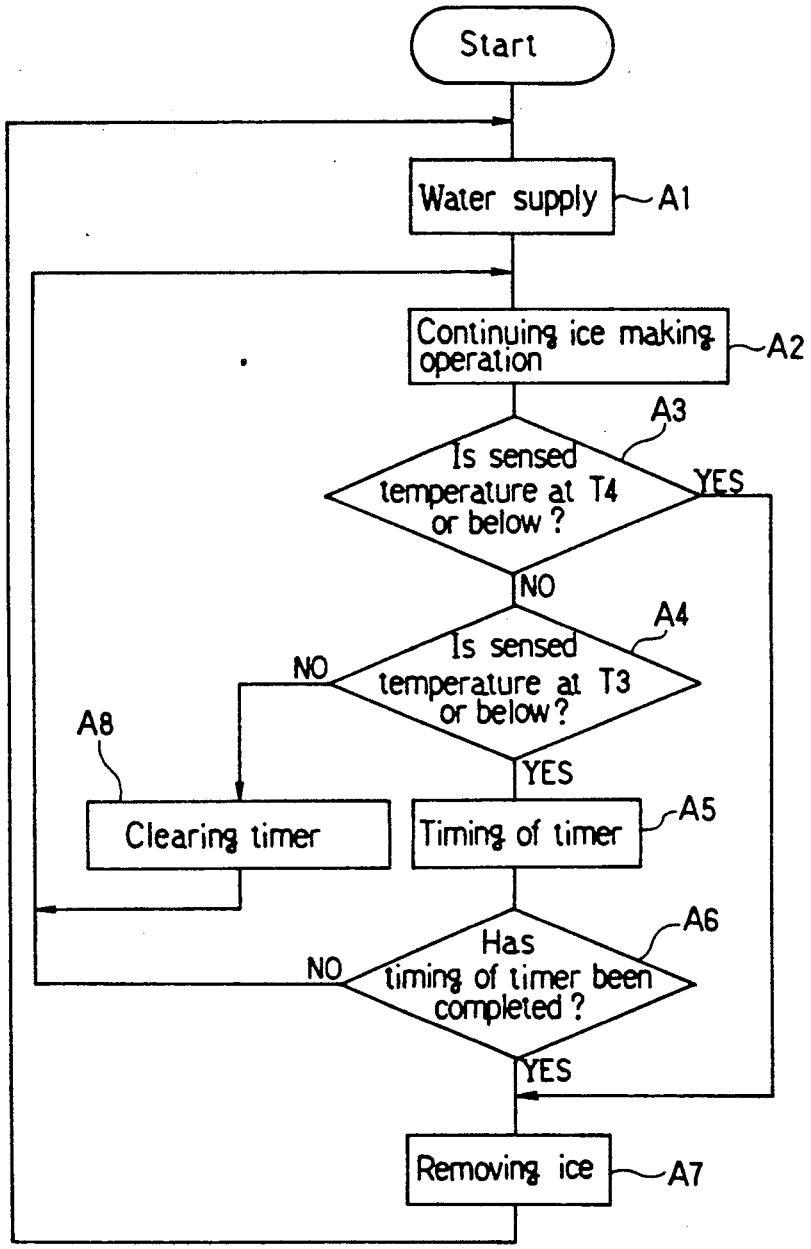
FIG. 5 is a view similar to FIG. 1 showing the operation of the ice maker of a second embodiment incorporated in a refrigerator.
Figure 6:
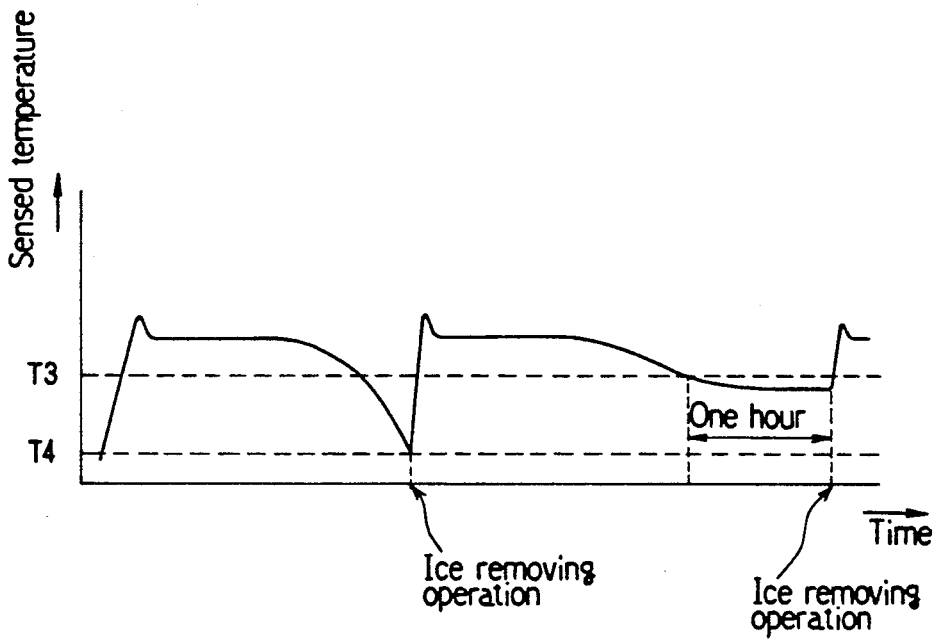
FIG. 6 is a view similar to FIG. 4 showing the change in the temperature of the ice in the second embodiment.

FIGS. 5 and 6 illustrate a second embodiment of the invention. In the second embodiment, the completion of the ice making is determined immediately when the sensed temperature falls to or below a lowest set temperature $T_4$ (−13.5° C., for example), as shown in FIG. 6. In this embodiment, a single timer is provided for initiating a timing operation when the sensed temperature is at or below a set temperature $T_3$ (−10° C., for example) other than the lowest set temperature $T_4$.

In a preferred embodiment, set temperature $T_3$ is −10° C., set temperature $T_4$ is −13.5° C., and the timing period of the timer is set at one hour.

The operation of the second embodiment of the invention will now be described. The case where the refrigerating efficiency is high will be described with reference to FIG. 5. The pump 1 is driven so that water is supplied to the ice tray 13 (step A1). The water in the ice tray 13 is cooled by chilled air fed into the ice making compartment, causing the ice making in the ice tray 13 to progress. The sensed temperature from the temperature sensing element 18 falls as the ice making progresses, as shown in FIG. 6. The timing operation of the timer is initiated when the sensed temperature falls to or below the set temperature $T_3$ (steps A2–A5). Since the refrigerating efficiency is high, the sensed temperature falls further to reach the lowest set temperature $T_4$ before the completion of the timing operation of the timer. Consequently, the completion of the ice making is determined, and the ice removing operation is performed (steps A3, A7). The water supply to the ice tray 13 is performed again after completion of the ice removing operation (step A1), and the above-described ice making is repeated.

When the refrigerating efficiency is lowered for some reason (for example, because of an increase in the amount of water to be frozen), the sensed temperature does not fall to or below the lowest set temperature $T_4$ even when all of the water in the ice tray 13 has been frozen, as shown in the right-hand portion of the graph of FIG. 6. In this case, the timing operation of the timer is initiated when the sensed temperature reaches the set temperature $T_3$ (steps A2–A6), and when the timing operation of the timer runs to completion (after, for instance, one hour), the completion of the ice making is determined and the ice removing operation is performed (steps A6, A7).

Consequently, the same advantages can be achieved in the second embodiment as in the first embodiment.

Although two set temperatures are provided in the foregoing embodiments, three or more set temperatures may be provided.

The foregoing disclosure and drawings are merely illustrative of the principles of the present invention and are not to be interpreted in a limiting sense. The only limitation is to be determined from the scope of the appended claims.

What is claimed is:

1. A refrigerator having an ice making compartment in which an ice maker is provided, the ice maker comprising:

an ice tray provided in the ice making compartment for containing an amount of water to be made into ice;

a temperature sensing element for sensing the temperature of the ice tray;

ice removing drive means for driving the ice tray so that ice is removed from the ice tray; and control means for controlling the ice removing drive means, the control means performing a timing operation in a duration of a condition that a sensed temperature sensed by the temperature sensing element is at each one of a plurality of set temperatures or below and detecting completion of the ice making operation based on a timed period during which the timing operation is performed, thereby operating the ice removing drive means, the timed period being reduced as a value of each set temperature is rendered small.

2. A refrigerator according to claim 1, wherein the control means is provided with two set temperatures, a first timer timing a long duration of the high set temperature condition and a second timer timing a short duration of the low set temperature condition.

3. A refrigerator according to claim 1, further comprising a storage compartment provided over the ice making compartment, a water tank provided in the storage compartment for reserving water and pump means for supplying the water reserved in the water tank to the ice tray.

4. A refrigerator having an ice making compartment in which an ice maker is provided, the ice maker comprising:

an ice tray provided in the ice making compartment for containing an amount of water to be made into ice;

a temperature sensing element for sensing the temperature of the ice tray;

ice removing drive means for driving the ice tray to remove ice from the ice tray; and control means for controlling the ice removing drive means, the control means being provided with a plurality of set temperatures, the control means detecting the completion of the ice making step immediately when a sensed temperature sensed by the temperature sensing element reaches the lowest set temperature or below, the control means timing a duration of a condition that the sensed temperature is decreased to the other set temperature or each one of the other set temperatures or below other than the lowest set temperature, thereby detecting completion of the ice making step based on the timed period.

5. A method of making ice in a refrigerator, comprising steps of:

supplying water to an ice tray provided in an ice making compartment;

freezing the water in the ice tray by a chilled air supplied into the ice making compartment;

timing a duration of a condition that a sensed temperature of the ice tray sensed by a temperature sensing element is at each one of a plurality of set temperatures or below;

detecting completion of an ice making step based on a timed period, the timed period being rendered shorter as the each set temperature becomes low; and operating ice removing drive means so that ice is removed from the ice tray.

6. A controller for regulating ice production in a refrigeration unit, said controller comprising:

temperature sensing means for sensing a temperature in said refrigeration unit;

timing initiation means for initiating a timing operation when said sensed temperature is less than or equal to at least one of a plurality of set temperatures, each of said plurality of set temperature having an associated timing duration;

timing means for performing a timing operation responsive to said timing initiation means; and ice removing drive means for initiating an ice removal operation responsive to the completion of said timing operation;

wherein the smallest of said at least one of said plurality of set temperatures to which said sensed temperature is less than or equal is a smallest set temperature;

the timing duration associated with said smallest set temperature is greater than the timing duration associated with any set temperatures smaller than said smallest set temperature but less than the timing duration associated with any set temperatures greater than said smallest set temperature; and the length of the timing operation performed by said timing means is equal to the timing duration associated with said smallest set temperature.

7. The controller of claim 6, wherein said plurality of set temperatures consists of two set temperatures.

8. The controller of claim 6, said refrigeration unit comprising:

an ice making compartment;

a storage compartment disposed over said ice making compartment;

a water reserving tank disposed within said storage compartment;

an ice maker disposed within said ice making compartment;

an ice tray disposed within said ice making compartment; and a pump for supplying water in said water reserving tank to said ice tray;

wherein said temperature sensing means senses the temperature of said ice tray.

9. A controller for regulating ice production in a refrigeration unit said controller comprising:

temperature sensing means for sensing a temperature in said refrigeration unit;

low temperature detection means for detecting when said sensed temperature is less than or equal to a specified lowest temperature;

timing initiation means for initiating a timing operation when said sensed temperature is less than or equal to at least one of one or more set temperatures;

timing means for performing a timing operation responsive to said timing initiation means; and ice removing drive means for initiating an ice removal operation responsive to said low temperature detection means and responsive to the completion of said timing operation;

wherein the smallest of said at least one of said plurality of set temperatures to which said sensed temperature is less than or equal is a smallest set temperature;

the timing duration associated with said smallest set temperature is greater than the timing duration associated with any set temperatures smaller than said smallest set temperature but less than the timing duration associated with any set temperatures greater than said smallest set temperature; and the length of the timing operation performed by said timing means is equal to the timing duration associated with said smallest set temperature.

10. The controller of claim 9, wherein said one or more set temperatures consists of one set temperature.

11. The controller of claim 9, said refrigeration unit comprising:

an ice making compartment;

a storage compartment disposed over said ice making compartment;

a water reserving tank disposed within said storage compartment;

an ice maker disposed within said ice making compartment;

an ice tray disposed within said ice making compartment; and a pump for supplying water in said water reserving tank to said ice tray;

wherein said temperature sensing means senses the temperature of said ice tray.

12. A method of controlling ice production in a refrigeration unit, said method comprising the steps of:

sensing a temperature in said refrigeration unit;

initiating a timing operation when said sensed temperature is less than or equal to at least one of a plurality of set temperatures;

performing a timing operation responsive to said timing initiation step; and initiating an ice removal operation responsive to the completion of said timing operation;

wherein the smallest of said at least one of said plurality of set temperatures to which said sensed temperature is less than or equal is a smallest set temperature;

the timing duration associated with said smallest set temperature is greater than the timing duration associated with any set temperatures smaller than said smallest set temperature but less than the timing duration associated with any set temperatures greater than said smallest set temperature; and the length of the timing operation performed by said timing means is equal to the timing duration associated with said smallest set temperature.

13. The method of claim 12, wherein said plurality of set temperatures consists of two set temperatures.

14. The method of claim 12, further comprising the steps of:

supplying water to an ice tray provided in an ice making compartment; and freezing the water in the ice tray with chilled air supplied into the ice making compartment, said temperature sensing step further comprising a step of sensing the temperature of the ice tray.

15. A method of controlling ice production in a refrigeration unit, said method comprising the steps of:

sensing a temperature in said refrigeration unit;

detecting when said sensed temperature is less than or equal to a specified lowest temperature;

initiating a timing operation when said sensed temperature is less than or equal to at least one of one or more set temperatures;

performing a timing operation responsive to said timing initiation step; and initiating an ice removal operation responsive to said low temperature detection step and responsive to the completion of said timing operation;

wherein the smallest of said at least one of said plurality of set temperatures to which said sensed temperature is less than or equal is a smallest set temperature;

the timing duration associated with said smallest set temperature is greater than the timing duration associated with any set temperatures smaller than said smallest set temperature but less than the timing duration associated with any set temperatures greater than said smallest set temperature; and the length of the timing operation performed by said timing means is equal to the timing duration associated with said smallest set temperature.

16. The method of claim 15, wherein said one of more set temperatures consists of one set temperature.

17. The method of claim 15, further comprising the steps of:

supplying water to an ice tray provided in an ice making compartment; and freezing the water in the ice tray with chilled air supplied into the ice making compartment, said temperature sensing step further comprising a step of sensing the temperature of the ice tray.

* * * * *